United States Patent [19]

Greiner et al.

[11] Patent Number: 4,712,318

[45] Date of Patent: Dec. 15, 1987

[54] GRIPPING ELEMENT FOR A SPORTS SHOE

[75] Inventors: Peter Greiner, Wangen; Hubert Pflüger, Wetzisreute; Horst Widmann, Schwaig, all of Fed. Rep. of Germany

[73] Assignee: Adidas Sportschuhfabriken Adi Dassler Stiftung & Co. KG, Fed. Rep. of Germany

[21] Appl. No.: 7,177

[22] Filed: Jan. 27, 1987

[30] Foreign Application Priority Data

Feb. 1, 1986 [DE] Fed. Rep. of Germany ..... 3603127

[51] Int. Cl.[4] ..... A43C 13/04; A43C 15/00

[52] U.S. Cl. ..... 36/134; 36/67 R; 36/67 D

[58] Field of Search ..... 36/134, 126, 127, 59 R, 36/67 R, 67 A, 67 B, 67 C, 67 D

[56] References Cited

U.S. PATENT DOCUMENTS

| | | | |
|---|---|---|---|
| 2,292,238 | 8/1942 | Pierce et al. | 36/67 D |
| 2,292,299 | 8/1942 | Smith | 36/67 D |
| 3,082,549 | 3/1963 | Dolceamore | 36/134 |
| 4,644,672 | 2/1987 | Dassler et al. | 36/134 |
| 4,648,187 | 3/1987 | Dassler et al. | 36/67 D |
| 4,667,422 | 5/1987 | Yamaguchi | 36/67 A |

FOREIGN PATENT DOCUMENTS

| | | | |
|---|---|---|---|
| 303612 | 11/1916 | Fed. Rep. of Germany | 36/67 A |
| 2539595 | 7/1984 | France | 36/67 R |
| 176911 | 5/1935 | Switzerland | 36/67 A |
| 179747 | 5/1922 | United Kingdom | 36/67 A |
| 2098457 | 11/1982 | United Kingdom | 36/134 |

*Primary Examiner*—Steven N. Meyers

[57] ABSTRACT

A gripping element for a sports shoe comprises a body portion of plastic material and a ceramic insert which is embedded into the body portion and which provides the ground-engaging surface of the element. The ceramic insert is surrounded over a part of its length by a metal sleeve which is also embedded into the body portion of the element. At least on its outside peripheral surface around which the metal sleeve extends, the ceramic insert has surface configurations such as annular ribs and/or grooves to provide a positive connection to the plastic material therearound, with a layer of plastic material between the ceramic insert and the metal sleeve.

14 Claims, 2 Drawing Figures

Fig. 1
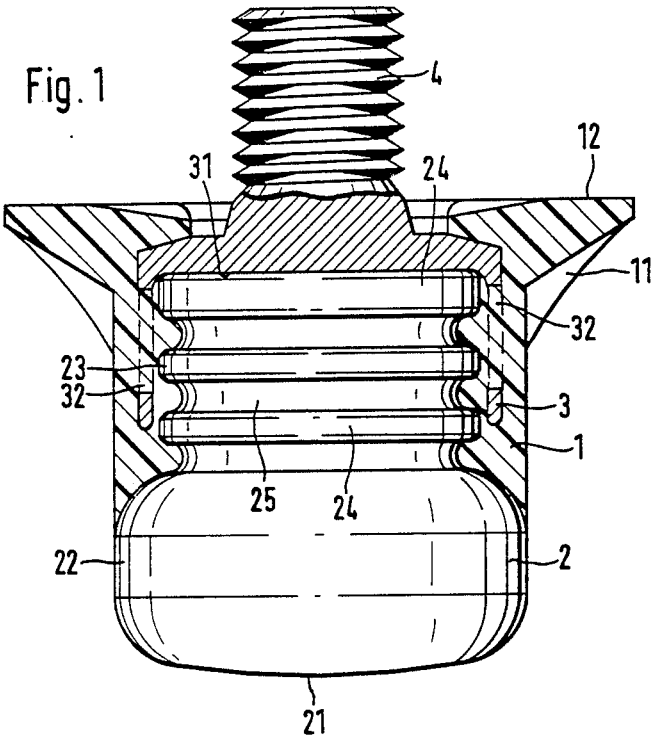
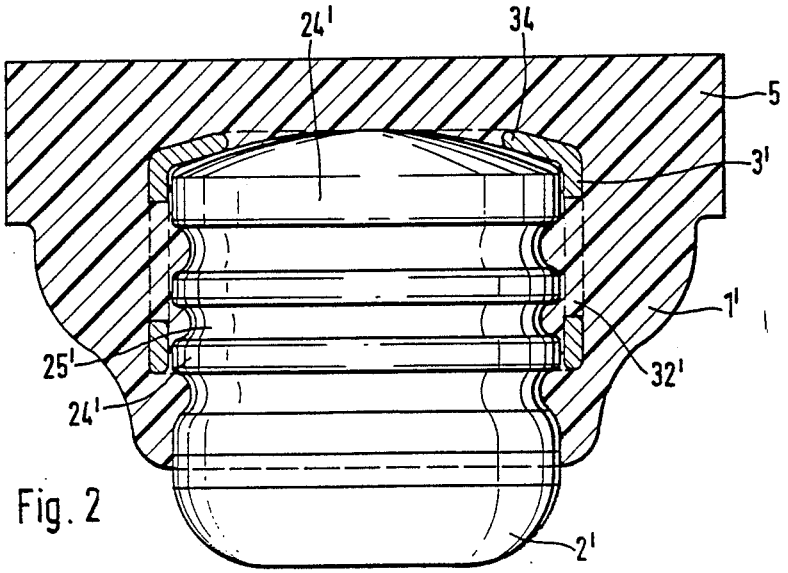
Fig. 2

GRIPPING ELEMENT FOR A SPORTS SHOE

BACKGROUND OF THE INVENTION

The present invention relates generally to a gripping element for a sports shoe or boot.

For the sake of simplicity herein, the term sports shoe will be used to cover any appropriate form of sports shoe, sports boot (being generally of a heavier construction than a sports shoe in the narrow sense) and the like.

There are many different forms of sports shoes having gripping elements or projections on the underneath of the sole thereof, for example for use in field-type sports such as football and the like. One of the problems which arises in regard to gripping elements on the soles of sports shoes are that the gripping elements tend to wear away, particularly when the person wearing the shoes walks across hard surfaces such as concrete, for example when gaining access to the playing field, and that in turn can cause the gripping elements to wear in such a way that they then have sharp edges and projections which can be the cause of possibly serious injury to other players.

In an effort to increase the operating life of such gripping elements and also to prevent the occurrence of sharp edges on the gripping elements due to wear thereof, with the attendant danger of injury, it has been suggested that ceramic inserts consisting for example of aluminum oxide, silicon carbide, tungsten carbide and the like, might be inserted into the elements, in order to make use of the high level of resistance to wear of ceramic materials. However, such gripping element constructions have not yet resulted in use of such gripping elements in practical situations, for two primary reasons, namely that it is very difficult to connect the ceramic insert to the body of the gripping element in such a way that the connection therebetween is capable of reliably withstanding the forces acting thereon in use of the sports shoe on which the gripping element is provided, and secondly, it is very difficult to keep the manufacturing cost at a level such that a ceramic gripping element is actually a viable proposition in comparison with gripping elements of conventional configurations. For example, in one form of gripping element having a ceramic insert, as set forth in German laid-open application (DE-OS) No 32 33 900, an oxide ceramic insert is injected directly into the body of the gripping element which consists of plastic material, or is secured therein by adhesive means. Experience in a practical situation has shown however that that form of connection between the ceramic insert and the body of the gripping element is not capable in the long term of withstanding in particular the thrust or shear forces which act perpendicularly to the longitudinal axis of the gripping element, with the result that the ceramic inserts come loose and are then lost.

In the face of that problem, it has been envisaged that a gripping element for a sports shoe may be provided which does not have a ceramic insert therein but in which the body of the gripping element also consists of ceramic material, as set forth in above-mentioned DE-OS No 32 33 900. Thus at its upper end, the body of the gripping element disclosed therein has a flange-like enlarged portion and openings or notches extending through the flange-like portion, and it is embedded in a carrier member of glass fibre-or carbon fibre-reinforced polyamide. In that arrangement, the plastic material of the carrier member is intended to penetrate into or through the openings or notches in the gripping element body portion and in that way fix it in position. The gripping element can then be fixed directly in the sole of a sports shoe by being embedded therein, by means of the above-mentioned plastic carrier member.

However, that gripping element construction is so expensive that it cannot be viably considered for use in relation to gripping elements which are to be low-cost articles.

SUMMARY OF THE INVENTION

An object of the present invention is to provide a gripping element for use on the sole of a sports shoe, which has a long service life in withstanding the forces which occur in use thereof.

Another object of the present invention is to provide a gripping element for use on the sole of a sports shoe, of a composite structure whose components are respectively adapted to the functions to be performed thereby while being of a simple and inexpensive construction.

Still another object of the present invention is to provide a stud for a sports shoe comprising a composite structure whose components are securely held together therein.

In accordance with the present invention, these and other objects are achieved by means of a gripping element for a sports shoe, comprising a body portion of plastic material and a ceramic insert embedded into the body portion to form the ground-engaging surface of the gripping element. A metal sleeve is also embedded in the body portion of plastic material and extends around the ceramic insert within the body portion over part of the length of the ceramic insert. On its outside surface, around which the metal sleeve extends, the ceramic insert is provided with engagement means such as recesses and/or projections, providing for positive engagement between the ceramic insert and the plastic material of the body portion of the gripping element. The plastic material of the body portion of the gripping element can thus engage into the above-mentioned recesses or embrace the above-mentioned projections.

It will be seen therefore that the above-indicated construction in accordance with the principles of the present invention provides a composite structure in which the plastic material of the gripping element serves to hold the ceramic insert in place by positive engagement, insofar as the plastic material penetrates into the recesses in the ceramic insert or embraces the projections on the outside surface thereof, while the metal sleeve which fits around the ceramic insert transmits the forces occurring in use of the gripping element to the body portion of the gripping element which extends therearound, in a more uniform fashion, that is to say, avoiding the production of high localised forces, thereby considerably increasing the service life of the holding structure, that is to say, the positive interconnection between the plastic material of the body portion of the gripping element and the ceramic insert. Where the gripping elements are produced on a sports shoe sole directly as by molding, thus forming integral studs or cleats thereon, the plastic material constituting the body portion of the gripping element will at the same time also be the material forming the sole of the shoe.

In order as far as possible to ensure that the plastic material constituting the body portion of the gripping element can properly embed the part of the ceramic insert which bears the recesses and/or projections, in the manufacturing operation, it is possible to envisage different configurations for the metal sleeve, although it will be appreciated that it would also be possible to combine different configurations jointly in a single metal sleeve. One embodiment of the metal sleeve provides that the metal sleeve has a plurality of apertures extending through the wall thereof and distributed over the periphery of the metal sleeve, through which apertures the plastic material which is in a fluid condition or which is still capable of flow in the manufacturing operation can penetrate into the interior of the metal sleeve in which the ceramic insert is disposed, and can thus flow through and around the above-mentioned recesses and projections on the outside wall surface of the ceramic insert. With that structure, the ceramic insert can be a comparatively close fit into the interior of the metal sleeve because the plastic material can readily gain access to the space within the metal sleeve through the above-mentioned apertures in the wall thereof. With such an arrangement, it has been found to be advantageous for the recesses and/or projections on the outside surface of the ceramic insert to be in the form of ribs or grooves which extend around the ceramic insert in the peripheral direction thereof and along which therefore the plastic material can also flow into those regions of the metal sleeve in which the metal sleeve does not have apertures through the outside wall thereof.

In another embodiment, there is clearance between the outside surface of the ceramic insert and the inside surface defined by the peripheral wall portion of the metal sleeve so that in the operation of manufacturing the composite gripping element the plastic material can penetrate into the interior of the metal sleeve from the end or ends thereof and can thus flow around and closely embrace the ceramic insert. In that structure, the clearance between the ceramic insert and the metal sleeve is to be just sufficient to permit the plastic material to flow into the metal sleeve and around the ceramic insert as indicated above; the layer of plastic material which is formed between the inside wall surface of the metal sleeve and the outside surface of the ceramic insert should be only a few tenths of a millimetre in thickness, more preferably only around 0.1 mm.

As, under normal conditions of use, the gripping element is subjected to a loading in particular in a vertical direction due to the weight of the person wearing the shoe on which the gripping element is disposed, it is advantageous for the metal sleeve to engage over the ceramic insert at least on a part of the end face of the ceramic insert which is embedded into the body portion of the gripping element, with the metal sleeve bearing directly against the above-mentioned end face of the ceramic insert. When the gripping element is of a detachable nature, that is to say it can be removed from the sole of the shoe for replacement purposes, with the gripping element having a metal shank portion which is embedded into the body portion of the gripping element and projecting from the top side thereof for fixing to the sole of the shoe, for example by screwing, the metal sleeve is advantageously formed in one piece with the metal shank portion. The end face of the metal shank portion which forms the inward end thus embedded in the body portion of the gripping element may be increased in width in a flange-like configuration so as to match the transverse dimension of the metal sleeve and can thus form the end portion of the metal sleeve against which the above-mentioned end face of the ceramic insert bears directly, that is to say, without any plastic material therebetween. To express that in a different fashion, the metal sleeve comprises a peripheral wall portion which extends around the ceramic insert over a part of the length thereof, and an end wall portion which closes the metal sleeve at the end thereof which in use faces towards the sole of the shoe, with the metal shank portion being fixed to or formed integrally with the end wall portion of the metal sleeve configuration.

The ceramic insert and in particular the part thereof which is surrounded by the metal sleeve is normally cylindrical, more particularly of circular cross-section, with the form of the metal sleeve being suitably matched thereto. It is also possible however to envisage a configuration which differs from a cylindrical shape, for example with the ceramic insert being of a rectangular or square or polygonal cross-section. In that case the metal sleeve must also be of a corresponding form. The ceramic insert may also be of transverse dimensions which remain substantially uniform over the longitudinal extent thereof, for example it may be in the form of a substantially cylindrical body. For reasons of saving weight and for reasons of reducing the outside dimensions in the case of a detachable gripping element, it is advantageous for the part of the ceramic insert which is embedded into the body portion of the gripping element, or more particularly at least the part of the ceramic insert around which the metal sleeve extends, to be reduced, that is to say, to be of smaller transverse dimensions, than the part of the ceramic insert which forms the ground-engaging surface at the free end of the gripping element. In that way, the part of the ceramic insert which forms the ground-engaging surface and which is required primarily to carry the forces occurring in use of the gripping element may also be of a pronounced lens-like configuration which affords maximum strength in relation to the combined loadings which occur in use of the gripping element (in that connection, reference may be made to German Utility Model No 85 21 733).

Further objects, features and advantages of the present invention will be apparent from the following description and the accompanying drawing.

BRIEF DESCRIPTION OF THE DRAWINGS

FIG. 1 is a view in longitudinal section through a gripping element of a stud-like configuration, and FIG. 2 is a similar view to that shown in FIG. 1 through a gripping element which is non-releasably connected to a sole to provide a cleat-like configuration thereon.

DESCRIPTION OF THE PREFERRED EMBODIMENTS

Referring firstly generally to the drawing, the gripping elements shown on an enlarged scale therein are of a rotationally symmetrical configuration in their essential components and in the configuration thereof so that there is no need to show an end view of the gripping elements. It should be appreciated however that a rotationally symmetrical configuration of the gripping element is not a necessary feature in regard to the principles of the present invention, but rather the gripping element may be of any suitable cross-sectional shape, for example it may be oval in cross-sectional shape or it may be of a prismatic configuration with for example a quadrangular or polygonal cross-section.

Referring firstly to FIG. 1, the gripping element or stud illustrated therein, in the form of a detachable element, comprises a gripping element body portion indicated generally at 1, a ceramic insert 2 and a metal sleeve 3 which is extended at the upward end thereof in FIG. 1, to provide a metal shank portion 4 having a male screwthread thereon for fixing to the sole of a sports shoe.

The body portion 1 of the gripping element comprises a plastic material, for example polyamide or polyurethane, which is capable of flow in the manufacturing process and which can be used for example in an injection molding operation to produce the body portion 1. The configuration of the body portion 1 of the gripping element is of the same kind as is known from conventional gripping elements, in particular studs, and does not therefore need to be described in greater detail herein. It will be appreciated also that the configuration employed at the outside of the body portion 1 of the gripping element is also not a critical aspect, as the outside configuration of the gripping element may be of any desired nature, being for example cylindrical or of a conically tapering kind.

Furthermore, in the same manner as conventional detachable studs, the gripping element illustrated in FIG. 1 has engagement surfaces as indicated at 11 for a tool or key for rotating the gripping element to screw it into or out of a suitable mounting in the sole of a sports shoe, while the contact surface 12 which comes to bear against the underneath surface of the outer sole (not shown) of the sports shoe, when the gripping element is screwed thereinto, may carry a surface structure or profiling which resists accidental rotary movement of the gripping element when it is in the condition of being fixed to the sole, thereby to prevent the gripping element from becoming unintentionally unscrewed.

The ceramic insert 2 may comprise for example aluminum oxide ($Al_2SO_3$), silicon carbide (SiC) or steatite.

As can be clearly seen from FIG. 1, the ceramic insert 2 has a lower portion 22 which is of a generally lens-like configuration and which provides the ground-engaging surface 21 of the gripping element, and an upper portion 23 which is reduced to a smaller diameter or transverse dimension in relation to the lower portion 22 and which is substantially cylindrical. The lens-like lower portion 22 has a ratio of diameter or transverse dimension to thickness of about 2.5: 1. The reduced upper portion 23 carries means for providing suitable positive or form-locking interengagement between the ceramic insert and the plastic material of the body portion 1 surrounding same, illustrated in the form of three annular ribs 24 which extend parallel to each other and in the peripheral direction of the ceramic insert. Between them, the ribs 24 form annular grooves or recesses 25 which correspondingly extend in the peripheral direction of the ceramic insert. The edges of the annular grooves and annular ribs are rounded.

The metal sleeve 3 comprises a suitable material such as steel and engages over the portion 23 of the ceramic insert, to a position approximately corresponding to the position of the lowermost annular rib 24 in FIG. 1. At its upper end in FIG. 1, the metal sleeve 3 provides a flat end face 31 against which the flat end face of the ceramic insert 2 directly bears. The diameter of the metal sleeve 3 is such that there is a clearance of the order of magnitude of 0.05 to 0. 1 mm between the inside wall surface of the metal sleeve 3 and the tops or crests of the annular ribs 25. Furthermore, the metal sleeve 3 has a plurality, for example as illustrated four, circular apertures 32 which are uniformly distributed around the periphery of the metal sleeve 3 and which are of such a size that they provide access to the two upper annular grooves 25.

It will be clearly seen from FIG. 1 that both the upper portion 23 of the ceramic insert 2 and the whole of the metal sleeve 3 are embedded into the plastic material making up the body portion 1 of the gripping element, and are positively held in position thereby. It will also be noted that the plastic material of the body portion 1 of the gripping element extends into the space defined between the inside wall surface of the metal sleeve 3 and the outside surface of the ceramic insert 2 which has the grooves and projections thereon, there forming a layer of plastic material which corresponds to the surfaces defining the above-mentioned space and by way of which the ceramic insert 2 is supported against the metal sleeve 3 when the gripping element is subjected to a loading, in the radial direction thereof. By virtue of the upper end face of the ceramic insert 2 bearing directly against the end portion 31 of the metal sleeve 3, no layer of plastic material is formed at that location when manufacturing the gripping element so that there is ceramic/metal contact between the cermic insert 2 and the metal sleeve 3, and consequently any vertical loadings applied to the gripping element are transmitted directly from the ceramic insert 2 to the metal sleeve 3 at more specifically the screwthreaded shank portion 4. The plastic material of the body portion 1 of the gripping element, which is in a condition of being capable of flow in the manufacturing operation, penetrates into the above-mentioned space defined within the metal sleeve 3 through the apertures 32 in the peripheral wall portion thereof, and the annular gap which is provided at the lower end of the metal sleeve 3 by virtue of the existence of the clearance between the inside surface of the metal sleeve 3 and the outside surface of the ceramic insert 2. Due to the annular grooves 25 extending uninterruptedly in the peripheral direction of the ceramic insert, the plastic material can also flow into and fill those regions of the space within the metal sleeve 3 into which the plastic material does not flow directly as it passes through the apertures 32 in the peripheral wall portion of the metal sleeve 3. The edges of the apertures 32 may be rounded (such rounding is not shown in the drawing) in order to minimise the possibility of the edges of the apertures 32 applying a shearing action to the plug-like portions of plastic material which extend from the exterior of the metal sleeve, through the apertures 32, into the space between the metal sleeve 3 and the ceramic insert 2.

Referring now to FIG. 2, the tapering gripping element shown therein comprises a body portion 1' which consists of the same plastic material as the outer sole of the shoe on which the gripping element is formed, as indicated at 5, being therefore molded in one piece therewith. Embedded in the plastic material of the body portion 1' is the ceramic insert 2' which is substantially cylindrical over its entire length, being provided in its upper portion with three annular ribs 24' which define between them corresponding annular grooves 25'. The upper end face of the ceramic insert 2' is of a convexly curved configuration, in the shape of a spherical segment, while a suitably inwardly extended portion 34 of a metal sleeve 3' engages over the edge of the upper end face of the ceramic insert 2', as clearly visible in FIG. 2, in such a way that there is direct contact between the end face of the ceramic insert and the inward surface of the portion 34 of the metal sleeve. The metal sleeve 3' has apertures 32', in the same manner as described above with reference to FIG. 1, and is of the same general configuration as the metal sleeve 3 shown in FIG. 1, in regard to its portion which engages over part of the length of the ceramic insert 2' and the apertures 32'. As in the FIG. 1 embodiment, an annular groove 25' is also provided beneath the lower edge of the metal sleeve 3' in the outside surface of the ceramic insert 2'.

In spite of being of the composite structure illustrated and described above, each of the two illustrated embodiments of the gripping element according to the invention can be produced in a single manufacturing operation. For that purpose the ceramic inserts 2 and 2' respectively are placed in position in a mold, with the respective metal sleeves 3 and 3' respectively positioned thereover in the manner shown in FIGS. 1 and 2 respectively, and then the plastic material of the body portion 1 of the gripping element is then cast around the ceramic insert and the metal sleeve co-operating therewith in the mold. In the embodiment shown in FIG. 2, as mentioned, the plastic material forming the body portion 1' of the gripping element also forms the sole 5 for the shoe.

In the casting operation, the plastic material passes through the apertures 32 and 32' and also from below into the space within the respective metal sleeve and thus produces the positive connection between the plastic material, metal sleeve and ceramic insert, whereby the ceramic insert is firmly held in position.

The above-described embodiments of FIGS. 1 and 2 of the gripping element of this invention were set forth solely by way of example and it is possible to deviate therefrom in various respects without thereby departing from the spirit and scope of the invention. As already mentioned above, the apertures 32 and 32' are not absolutely necessary if, by selecting suitable dimensions for the ceramic insert and the metal sleeve or by using a plastic material which is particularly capable of flow around those components, it is possible to ensure that an adequate amount of plastic material can penetrate into the space between the metal sleeve and the ceramic insert, from the lower end of the metal sleeve. Furthermore, instead of the illustrated apertures 32 and 32' which communicate with both of the annular grooves between the annular ribs 24 and 24', it is also possible to provide a larger number of apertures which are each of smaller area and which are arranged for example one above the other in the axial direction of the metal sleeve, each thereby communicating with a respectively associated annular groove. Finally, the apertures may also be of any desired configuration differing from the circular shape referred to above. It is desirable however for the apertures not to extend through the lower edge of the metal sleeve because that would adversely affect the capability of the metal sleeve for supporting the ceramic insert which is disposed therewithin. If there are no apertures in the metal sleeve so that the plastic material penetrates into the metal sleeve from the end thereof, it is desirable for the ceramic insert to have ribs and grooves which extend in the longitudinal direction thereof, to facilitate the flow of plastic material within the metal sleeve, or alternatively it is possible for the annular grooves illustrated to be interrupted at various locations at the periphery thereof in order similarly to facilitate the flow of plastic material into the metal sleeve. In a construction where the metal sleeve surrounds the ceramic insert with a clearance therebetween, it is possible to take steps to provide for centering of the metal sleeve on the ceramic insert in the manufacturing operation, similarly to the convexly curved configuration of the upper end face of the ceramic insert as shown in FIG. 2, and the end face of the metal sleeve which is of a complementary configuration therewith.

We claim:

1. A gripping element for a sports shoe comprising a body portion of plastic material, a ceramic insert embedded into the body portion to form the ground-engaging surface of the gripping element, and a metal sleeve means extending around said insert within said body portion over a part of the length of said insert, said insert being provided at least on its outside surface around which said metal sleeve extends with engagement means adapted to provide for positive engagement between said insert and the plastic material of said body portion.

2. An element as set forth in claim 1 wherein said engagement means comprise a plurality of recesses in said outside surface of said insert.

3. An element as set forth in claim 1 wherein said engagement means comprise a plurality of projections on said outside surface of said insert.

4. An element as set forth in claim 1 wherein said metal sleeve means comprises at least one wall portion having aperture means therethrough.

5. An element as set forth in claim 1 wherein said metal sleeve means extends around said insert with clearance between the inside surface of said metal sleeve means and said outside surface of said insert.

6. An element as set forth in claim 1 wherein said part of said insert around which said metal sleeve means extends is at least substantially cylindrical and has groove means in its said outside surface providing said engagement means.

7. An element as set forth in claim 1 wherein said part of said insert around which said metal sleeve means extends is substantially cylindrical and has annular ribs on its said outside surface providing said engagement means.

8. An element as set forth in claim 6 wherein said part of said insert around which said metal sleeve means extends is of a round cross-section.

9. An element as set forth in claim 7 wherein said part of said insert around which said metal sleeve extends is of a round cross-section.

10. An element as set forth in claim 1 wherein said metal sleeve means engages over said insert at least a part of the end face of said insert and bears directly against said end face.

11. An element as set forth in claim 1 including a metal shank portion on said metal sleeve means formed integrally therewith and extending out of said body portion, for releasably securing the gripping element to the sole of a said shoe.

12. An element as set forth in claim 11 wherein said metal sleeve means has an end portion bearing directly against the adjacent end face of said insert, with said metal shank portion being provided on said end portion of said metal sleeve means.

13. An element as set forth in claim 1 wherein the portion of said insert which provides said ground-engaging surface is of a lens-shaped configuration and the part of said insert around which said metal sleeve means extends is reduced in relation to said lens-shaped portion.

14. A gripping element for the sole of a sports shoe, comprising: a body portion of plastic material; a sleeve means embedded in the body portion; and an insert means of ceramic material embedded in said plastic material within said sleeve means and having first and second ends, an end portion of said insert means which constitutes said first end projecting outwardly from said body portion thereby to provide a groundengaging surface of said gripping element and said sleeve means being of such a length as to extend over only a part of the length of said insert means from said second end thereof, at least the part of said insert means around which said sleeve means extends providing recess means into which the plastic material of said body portion engages to provide for a positive connection between said plastic material of said body portion and said ceramic insert within said sleeve means.

* * * * *